US008667975B1

(12) United States Patent
Chessum

(10) Patent No.: US 8,667,975 B1
(45) Date of Patent: Mar. 11, 2014

(54) UMBRELLA FOR DRIPLESS CLOSURE

(71) Applicant: Charlene F. Chessum, Fresno, CA (US)

(72) Inventor: Charlene F. Chessum, Fresno, CA (US)

( * ) Notice: Subject to any disclaimer, the term of this patent is extended or adjusted under 35 U.S.C. 154(b) by 0 days.

(21) Appl. No.: 13/727,552

(22) Filed: Dec. 26, 2012

(51) Int. Cl.
*A45B 19/04* (2006.01)
*A45B 25/18* (2006.01)
*A45B 19/00* (2006.01)

(52) U.S. Cl.
CPC ..... *A45B 19/04* (2013.01); *A45B 25/18* (2013.01); *A45B 2025/186* (2013.01); *A45B 2019/002* (2013.01)
USPC ..... 135/25.4; 135/28; 135/33.2; 135/31

(58) Field of Classification Search
CPC ..... A45B 19/10; A45B 19/04; A45B 25/02; A45B 25/18; A45B 2025/105; A45B 2019/002; A45B 2025/186; A45B 2019/008
USPC ..... 135/15.1, 20.3, 25.1, 25.4, 25.41, 28, 135/31, 33.2, 34.2, 39, 48
See application file for complete search history.

(56) References Cited

U.S. PATENT DOCUMENTS

| | | | | |
|---|---|---|---|---|
| 3,844,301 | A * | 10/1974 | Harrell | 135/15.1 |
| 4,084,600 | A * | 4/1978 | dePolo | 135/15.1 |
| 4,842,003 | A * | 6/1989 | Baldwin et al. | 135/19.5 |
| 5,188,137 | A * | 2/1993 | Simonelli | 135/19.5 |
| 5,690,131 | A * | 11/1997 | Voigt | 135/19.5 |
| 6,273,111 | B1 | 8/2001 | Weiss et al. | |
| 6,805,144 | B2 * | 10/2004 | Usui et al. | 135/34.2 |
| 7,581,554 | B2 * | 9/2009 | Glasser | 135/19 |
| 8,225,806 | B1 * | 7/2012 | Simonelli | 135/27 |
| 2004/0211451 | A1 * | 10/2004 | Goh | 135/31 |
| 2005/0247334 | A1 * | 11/2005 | Erickson | 135/33.2 |
| 2008/0163907 | A1 * | 7/2008 | Garner | 135/15.1 |
| 2009/0223545 | A1 * | 9/2009 | Beyer et al. | 135/31 |

FOREIGN PATENT DOCUMENTS

| | | | | |
|---|---|---|---|---|
| FR | 2681224 | A1 * | 3/1993 | A45B 19/00 |

* cited by examiner

*Primary Examiner* — Winnie Yip
(74) *Attorney, Agent, or Firm* — Richard A. Ryan

(57) ABSTRACT

An improved umbrella configured to reduce the likelihood that water on top of the umbrella will drain onto the area around the user when the umbrella is closed. The improved umbrella has a handle supporting a canopy section comprising of an upper canopy, a lower canopy and a collapsible frame attached to and disposed between the upper and lower canopies. An operating mechanism allows the user to move the umbrella between its open and closed positions. When being closed, the operating mechanism inverts the frame so the peripheral edge of the upper canopy is directed upward and the center area thereof is pulled down into an interior cavity at the top end of the handle so water will drain inward to the cavity instead of outward. The upper canopy is pulled into the cavity and the frame, with the lower canopy wrapped around it, is collapsed against the handle.

12 Claims, 3 Drawing Sheets

UMBRELLA FOR DRIPLESS CLOSURE

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACK GROUND OF THE INVENTION

A. Field of the Invention

The present invention relates generally to hand-held umbrellas that are utilized by a person to substantially prevent rain, snow or other moisture from getting at least the upper portion of his or her body wet. In particular, the present invention relates to retractable, hand-held umbrellas that collapse to a smaller size when not being utilized to protect the user thereof. Even more particularly, the present invention relates to such umbrellas that are configured to prevent water from dripping onto the floor, in a vehicle, inside the user's bag or etc. when the umbrella is in the closed position following being used in wet conditions.

B. Background

Umbrellas of various designs have been in use for many years to prevent water, whether originating from rain, snow, fog or other weather-related sources of moisture, from getting at least the upper portion of the umbrella user's body and clothes wet. As well known, a typical umbrella generally comprises a handle that is generally held by the user at or near the lower end thereof, a canopy section which includes a frame that supports a water resistant canopy which is sized and configured to provide the desired amount of protective cover that prevents part of the person and his or her clothes from getting wet and a canopy operating mechanism which connects the handle and the frame to open and close the canopy section. Although some umbrellas utilize a fixed length handle, it is well known that many umbrellas have a handle that is telescopically configured to allow the user to extend the canopy section outwardly when he or she wants to use the umbrella to protect against rain or other sources of moisture and retracts inwardly when the umbrella is not needed to make the umbrella much easier to transport and store. Likewise, although some umbrellas have a fixed open canopy section, most present umbrellas have a canopy section that is configured to at least generally collapse, typically around the handle, to make the umbrella much easier to transport and store. The frames of these umbrellas are structured and arranged to expand to an open position that holds the canopy in position to protect the person and his or her clothes and to collapse itself and the canopy to a closed position which is much more compact. The typical umbrella has a canopy made of a single layer of water resistant material or materials that are selected so as to be able to repeatedly move, through its connection to the frame, between the umbrella's open and closed positions. Typically, the canopy operating mechanism is slidably engaged on the handle such that pushing it upward opens the canopy section and pulling it downward closes the canopy section. A locking device associated with the canopy operating mechanism locks the canopy section in its open position. Many umbrellas combine the features of both the telescoping handle and the collapsible canopy section. Some umbrellas utilize springs or other mechanisms to mechanically extend and retract the handle and/or to expand and collapse the canopy section of the umbrella.

As generally well known by persons who utilize an umbrella having a collapsible canopy section, when the umbrella is moved from its open position to its closed position the collapsing of the canopy section around the handle folds the outer surface of the canopy downward toward the user as the inner surface of the canopy section collapses against the handle. Unfortunately, this results in the water that is on the outer surface of the canopy draining down the folded canopy onto and around the surrounding area, such as the floor, vehicle, inside a bag and the like. This water, which can be a substantial amount, commonly creates problems for the user with regard to trying to contain the water from accumulating on the floor, furniture or other surface around the user or inside a bag, sack or the like. One situation where this problem is perhaps the most noticeable is when the user is placing the umbrella in its closed position while getting into a car, truck or other vehicle after walking to the vehicle in the rain, snow or heavy fog or when entering a dwelling and trying to keep the water off the floor in order to avoid slips and falls. As the user approaches the vehicle in the rain, most of the water runs off of the canopy in a direction away from the user. When he or she gets into the vehicle, the umbrella is moved to its closed position. As the canopy section collapses, the water remaining on the outer surface of the canopy will drain down the canopy and onto the surrounding area. To avoid getting water everywhere while closing the umbrella or while the umbrella is in the closed position, the user often will get at least substantially into the vehicle and close the umbrella while it is extended away from the user and outside the vehicle. Unfortunately, when bringing the collapsed umbrella into the vehicle water gets everywhere until the user drops the wet umbrella onto the floorboard where the remainder of the water continues to puddle. When entering a building such as an dwelling, office, store or the like with a wet umbrella, the user will typically leave the umbrella outside (if possible) or put it in an umbrella bag provided by the store (if available). If these or like options are not available, which is likely the most common occurrence, the umbrella drips on the floor wherever the user moves through the building. For most people, these scenarios are not acceptable, but they do not have a choice with the current umbrella configuration.

The problem with getting water everywhere when closing a wet umbrella is a result of the configuration of the umbrella's collapsible frame. As well known, the canopy operating mechanism typically pulls the frame in around the top of the handle and folds the canopy inward against the top of the handle. In this manner, the canopy section collapses by the canopy folding generally downward, which causes the water to drain off of the outer surface of the canopy and onto the surrounding area, thereby, at least somewhat frustrating his or her efforts to keep areas dry. Some attempts have been made to address the water problems that result from a wet umbrella. For instance, U.S. Pat. No. 6,273,111 to Weiss, et al. discloses a retractable umbrella that has a frame which folds the peripheral edge of the canopy upward and the center of the canopy downward in an attempt to keep the water on the upper surface of the canopy from running down. The entire canopy and frame are pulled down into an interior cavity of a housing by a shaft that interconnects the canopy and the frame. The inverted closed position, with the term "inverted" being relative to the folding pattern of a typical umbrella, of the umbrella of Weiss is intended to reduce the likelihood that water will get everywhere when closing the umbrella by folding the wet upper surface of the canopy upward and then down into the interior cavity of the housing instead of folding the canopy downward as is done with most prior art umbrellas. Weiss also discloses use of a retractable umbrella, configured as described above, having a spring-operated mechanism to mechanically operate the umbrella.

Despite the advantages described in the patent to Weiss, most people still utilize umbrellas that fold the canopy downward and, as a result, cause the water on the upper surface of the canopy to run onto the surrounding area as he or she attempts to close the umbrella. What is needed, therefore, is an improved umbrella that is specially configured to substantially reduce the likelihood that water will get everywhere when he or she places the umbrella in its closed position. Preferably, the new umbrella will generally function, from the user's standpoint, in a similar manner to conventional umbrellas yet be configured to reduce the likelihood of water getting everywhere when closing the umbrella. The improved umbrella should have a frame that is structured and arranged to fold the canopy in an inwardly direction, opposite conventional umbrellas, so the water on the outer surface thereof will drain inward and not outwardly onto the surrounding area. The canopy section of the new umbrella should be configured to cooperatively fold with the frame while reducing the likelihood of water getting everywhere from water draining off of the upper surface of the canopy.

SUMMARY OF THE INVENTION

The umbrella for dripless closure of the present invention provides the benefits and solves the problems identified above. That is to say, the present invention discloses an improved umbrella that substantially reduces the likelihood the area around the user (including bags, packages, floors, seats and the like in the area) will get wet when he or she moves the umbrella into its closed position. Unlike conventional umbrellas, the new umbrella of the present invention has a frame that is structured and arranged to fold the canopy in an inwardly direction, opposite conventional umbrellas, so the water on the outer surface thereof will drain inwardly and not outwardly onto the surrounding area. The canopy section of the new umbrella has an upper canopy and a lower canopy, relative to the frame thereof, that are configured to cooperatively fold with the frame in a manner that reduces the likelihood the surrounding area will get wet from water draining off of the upper surface of the canopy when it is being closed. The upper water repellant canopy folds down with the upward folding of the frame and is pulled into a cavity at the upper end of the handle. The lower canopy folds upward with the frame and, by action of the frame, is collapsed against the upper end of the handle. In this manner, any water on the upper surface of the upper canopy is drained inwardly down into the cavity instead of outwardly onto the area around the user. From the user's perspective, other than not getting water everywhere, the new umbrella generally functions in a manner that is substantially similar to conventional umbrellas. In a preferred configuration, the umbrella of the present invention will be easy for the typical person to use.

In one embodiment of the present invention, the umbrella for dripless closure generally comprises an elongated handle having an upper end and a lower end, a canopy section that is disposed generally at the upper end of the handle, an interior cavity at the upper end of the handle and a canopy operating mechanism associated with the handle and connected to the frame for moving the umbrella between its open position and its closed position. The canopy section of the improved umbrella has an upper canopy, a lower canopy and a frame attached to and disposed between the upper and lower canopies. The frame is structured and arranged to peripherally support the upper canopy such that an upper surface thereof extends toward a generally downwardly disposed, outwardly extending peripheral edge of the upper canopy so as the umbrella will provide protective cover when in its open position and to collapse the upper canopy when the umbrella is moved to a closed position. The lower canopy is configured to extend below the upper canopy when the umbrella is in its open position and to collapse around the frame when the umbrella is in the closed position. The interior cavity located at the upper end of the handle is sized and configured to receive substantially all of the upper canopy therein when the umbrella is moved to its closed position. The canopy operating mechanism has a locking device that is configured to hold the umbrella in the open position. In operation, the canopy operating mechanism raises the peripheral edge of the upper canopy upward and pulls a center area of the upper canopy downward into the interior cavity when moving the umbrella to its closed position and pulls the upper canopy out of the interior cavity when moving the umbrella to its open position. As such, any water on the upper surface of the upper canopy when the umbrella is moved to its closed position will be directed inwardly along the upper surface of the upper canopy down an inward water drain path toward the center area of the upper canopy to prevent the water from draining outwardly past the peripheral edge of the upper canopy when the umbrella is moved to and disposed in its closed position. The water in that collects in the interior cavity of the handle, with the upper canopy, can be drained from the cavity at a time and place that is convenient for the user. In one embodiment, the canopy operating means comprises one or more connecting members that interconnect the center section of the upper canopy and the frame, with the connecting members being structured and arranged to pull the center section of the upper canopy into the interior cavity when the umbrella is placed in the closed position. If desired, the handle of the improved umbrella can be telescopically configured for ease of transporting and storing the umbrella.

Accordingly, the primary aspect of the present invention is to provide an improved umbrella that has the advantages discussed above and elsewhere in the present disclosure and which overcomes the various disadvantages and limitations associated with prior art umbrellas.

It is an important aspect of the present invention to provide an improved umbrella that is specially configured to reduce the likelihood that the area surrounding the user thereof will get wet from water draining off of the upper surface of the canopy when he or she closes the canopy section of the umbrella and keep the area free from getting wet from dripping water as the user carries the closed umbrella.

It is also an important aspect of the present invention to provide an improved umbrella that has a canopy section which comprises a frame that is structured and arranged to fold an upper canopy generally inward, instead of outward, so as to drain any water on the upper surface of the upper canopy towards the center of the umbrella to reduce the likelihood that the area surrounding the user will get wet as a result of water draining from the upper canopy and to keep the area free from water as the user moves about with the closed umbrella.

It is also an important aspect of the present invention to provide an improved umbrella that comprises a frame which supports an upper canopy made of a water repellant material above the frame and which supports a lower canopy made out of a stretch material below the frame in a manner that the two canopies will cooperate together to reduce the likelihood that the area surrounding the user will get wet during the closure of the umbrella.

It is also an important aspect of the present invention to provide an improved umbrella having an upper water resistant canopy that is pulled into a cavity located at the top of the handle in a manner that drains the water inwardly instead of outwardly to reduce the likelihood of the area surrounding the user getting wet while he or she is closing the umbrella.

Another important aspect of the present invention is to provide an improved umbrella that, from the user's general perspective, is operated in much the same manner as conventional umbrellas.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show and discuss certain shapes and configurations for the components of the new umbrella, those skilled in the art will understand that this is merely for purposes of simplifying this disclosure and that the present invention is not so limited.

For purposes of describing the new umbrella of the present invention various terms are utilized to assist with illustrating the relationships between the components of the new umbrella, as well as prior art conventional umbrellas, to each other and at least generally to the user. Such terms as "upper", "upright", "upwardly", "lower", "downward", "downwardly" and the like are utilized to refer to the umbrella when it is held in a generally vertical position so the umbrella will provide cover for the user's head, upper torso and the upper portion of the user's clothes. Likewise, such terms as "outward", "outwardly", "inward", "inwardly" and the like are utilized to refer to a direction relative to, as appropriate, the center of the umbrella, the umbrella's handle and/or the user when he or she is standing or sitting generally under the umbrella. As will be readily appreciated by those skilled in the art, umbrellas can be turned at a wide variety of angles relative to being vertical. As such, the use of these terms herein is for illustrative purposes to show how the components of the new umbrella connect, interact and are positioned relative to each other when the umbrella is held in a vertical condition and is not intended to limit the umbrella or use thereof any other manner.

Figure 1:
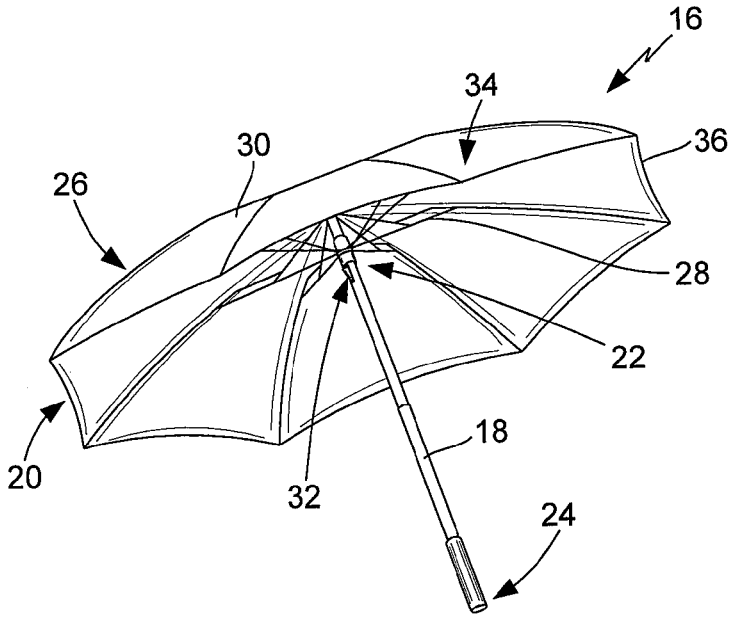
FIG. 1 (PRIOR ART)
FIG. 1 is a side perspective view of a prior art umbrella shown in its open position to protect a user from rain or other weather related moisture.
Figure 2:
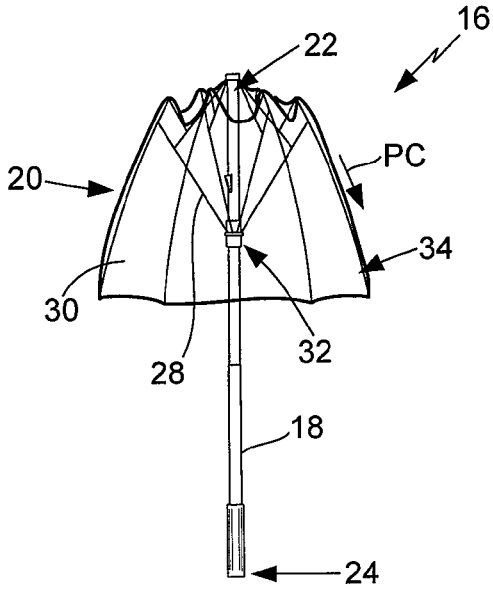
FIG. 2 (PRIOR ART)
FIG. 2 is a side view of the prior art umbrella of FIG. 1 shown in a partially closed position showing how water drains outwardly off of the upper surface of the canopy when the umbrella is being closed, with the canopy shown as transparent to better illustrate the components of the prior art umbrella.

An umbrella that is configured pursuant to various embodiments of the present invention is shown generally as 10 in FIGS. 3 through 7. As set forth in more detail below and illustrated in the umbrella 10 of the present invention is specially configured to reduce the likelihood that the user of the umbrella 10 will not get wet as a result of water draining onto him or her as the user moves the umbrella 10 from its open position 12, shown in FIG. 3, to its closed position 14, shown in FIGS. 5 and 7. To accomplish the various objectives and achieve the desired aspects of the present invention, umbrella 10 is configured somewhat different than a conventional prior art umbrella 16, an example of which is shown in FIGS. 1 and 2. As well known, a conventional collapsible umbrella 16 has a handle 18 and a canopy section 20 that function together to protect the user from getting wet due to rain, show, heavy fog or other weather related moisture. The canopy section 20 is generally positioned at or near the upper end 22 of handle 18 and the user typically holds the umbrella 16 in a generally upright position with his or her hand at or near the lower end 24 of handle 18.

In the open position 26 of conventional umbrella 16 shown in FIG. 1, the frame 28 of the canopy section 20 is in its outwardly or extended condition to support a water repellant canopy 30 generally above the user's head so as to at least substantially prevent any rain or other moisture from getting on the user's head and prevent the upper part of their clothes from getting wet. Umbrella 16 has a canopy operating mechanism 32 that is configured to allow the user to open and close the canopy 30. Typically, the canopy operating mechanism 32 interconnects the handle 18 and the frame 28 and is cooperatively structured so as to fold and unfold the canopy 30. As well known, and shown in FIG. 2, as the conventional umbrella 16 moved to its closed position (not shown) any water on the upper surface 34 of canopy 30 will drain in a generally outwardly direction along a conventional water drain path, shown as PC in FIG. 2, all along the upper surface 34 of the canopy 30 that results in the water flowing past the peripheral edge 36 of the canopy 30 and falling onto the falling onto the floor, seat or other surface where the user is standing when he or she closes the umbrella 16. Although this result is well known and disfavored by most people, at least those who do not want the water falling on the nearby surface, it is very common with conventional umbrella 16. The umbrella 10 of the present invention solves the problem of water draining onto the surrounding area from the upper surface 34 of canopy 30 when the user closes umbrella 10 and prevents water dripping from umbrella 10 when the user carries the closed umbrella 10.

Figure 3:
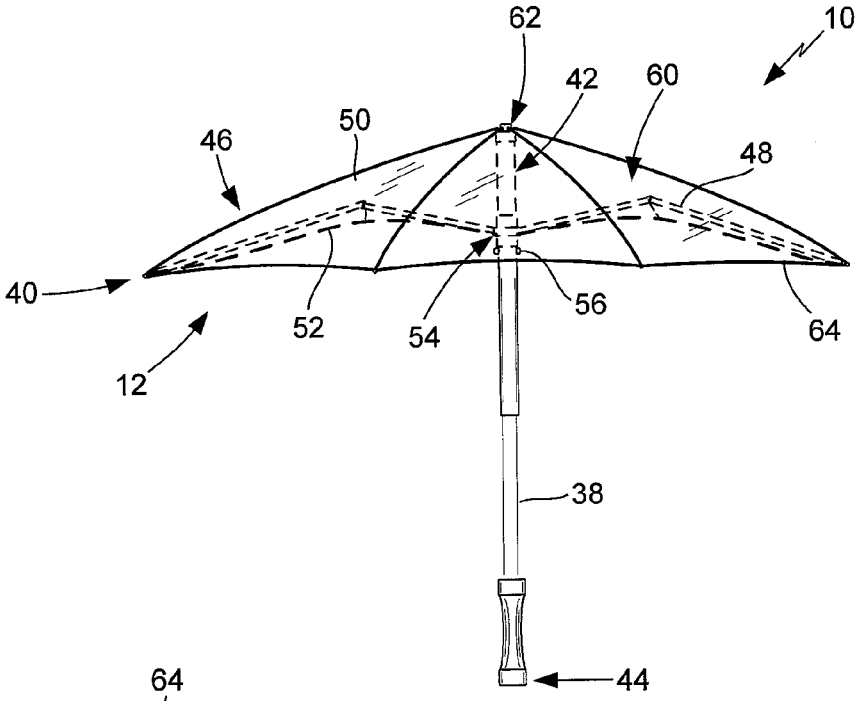
FIG. 3 is a side view of the present umbrella configured according to one of the preferred embodiments of the present invention shown in its open position with the upper canopy and the lower canopy shown as transparent to better illustrate the frame and the top end of the handle.

As with the conventional umbrella 16, the improved umbrella 10 has an elongated handle 38 and a canopy section 40 that function together to protect the user from getting wet due to rain, show, heavy fog or other weather related moisture, as shown in FIGS. 3 through 7. The canopy section 40 of umbrella 10 is generally positioned at or near the upper end 42 of handle 38 and the user typically holds the umbrella 10 in at least a generally upright position with his or her hand at or near the lower end 44 of the handle 38. In the open position 46 of umbrella 10, shown in FIG. 3, the frame 48 of the canopy section 40 is in its outwardly or extended condition to support a water repellant upper canopy 50 above frame 48 so the user can position the upper canopy 50 generally above his or her head so as to at least substantially prevent any rain or other moisture from getting on the user's head and prevent the upper part of his or her clothes from getting wet. The umbrella 10 of the present invention also has a lower canopy 52 that is supported by frame 48 generally below frame 48. As with the conventional umbrella 16, the improved umbrella 10 has a canopy operating mechanism 54 that is configured to allow the user to easily open and close the canopy section 40 as needed or desired. The canopy operating mechanism 54 interconnects the handle 38 and the frame 48 and is cooperatively structured so as to fold and unfold the canopy section 40. In one common configuration, canopy operating mechanism 54 is slidably disposed along the upper portion of the handle 38 and it comprises a locking device 56 that is structured and arranged to allow the user to lock the canopy section 40 in its open position 40, as shown in FIG. 3. As set forth in more detail below and shown in FIGS. 4-7, as umbrella 10 is moved to its closed position 58 (FIGS. 5 and 7) any water on the upper surface 60 of upper canopy 50 will drain in a generally inwardly direction along the inward water drain path PI, shown in FIG. 6, from all along the upper surface 60 of the upper canopy 50. This results in the water flowing toward the center area 62 of upper canopy 50 instead of past the peripheral edge 64 of the upper canopy 50, which would result (as it does with conventional umbrella 16) in the water draining onto the surrounding area of the user, such as onto the floor, seat or other surface where the user is standing when he or she moves umbrella 10 to its closed position 58, which also reduces the likelihood that water will drip from umbrella 10 as the user carries the umbrella 10 in its closed position 58.

Figure 4:
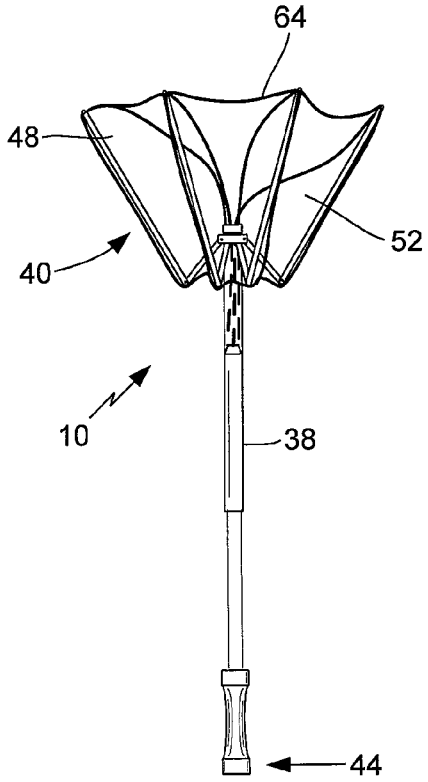
FIG. 4 is a side view of the present umbrella of FIG. 3 shown in a partially closed position.
Figure 5:
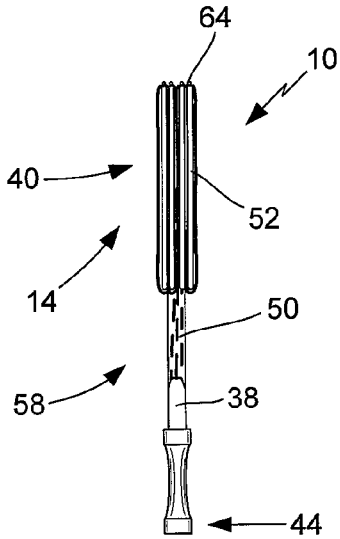
FIG. 5 is a side view of the present umbrella of FIG. 3 shown in its closed position with the upper canopy being at least substantially disposed in a cavity at the top end of the handle and the handle telescopically retracted.

As will be readily appreciated by those skilled in the art, the frame 48 comprises a plurality of interconnected frame members 66 that allow frame 48 to be structured and arranged to accomplish the objectives of the umbrella 10 of the present invention, namely to keep the water on the upper surface 60 of the upper canopy 50 from draining onto the user or around the user when umbrella 10 is moved to its closed position 58. Various frame members 66 are attached to the upper canopy 50 and the lower canopy 52 such that movement of the frame 48 will correspondingly move the upper canopy 50 and the lower canopy 52. In the open position 46, the frame members 66 of frame 48 lock in their extended position to peripherally support the upper canopy 50 above the frame 48 and the lower canopy 52 along the bottom of the frame 48, with the peripheral edge 64 of the upper canopy 50 disposed in a generally downward position, as shown in FIG. 3. In one configuration, frame members 48 are made out of aluminum or other light weight, corrosion resistant materials and are pivotally connected together using devices that are well known in the art for such purposes. As will be appreciated by those skilled in the art, other than being structured and arranged to fold in the generally opposite direction as prior art conventional umbrellas, such as umbrella 16, the frame 48 is configured and operates in much the same manner as the frame 28 used with umbrella 16. Because the frame 48 of umbrella 10 folds in the manner it does, namely folding upward to raise the peripheral edge 64 of the upper canopy 50 above the center area 62 thereof (as shown in FIGS. 4 and 5), the water on the upper surface 60 of upper canopy 50 will be directed inwardly along the inward water drain path PI toward the center area 62 of the upper canopy 50, as best shown in FIG. 6.

The upper canopy 50 is fixedly attached to the upper side of frame 48 and will move with the frame 48 as the umbrella 10 moves between the open 46 and closed 58 positions. Preferably, the upper canopy 50 made out of a water resistant or waterproof material that, in addition to being able to repel water, can be extended tight to provide the desired protective cover when in the umbrella 10 is in its open position 46, as shown in FIG. 3, but is also sufficiently flexible that it will be folded inwardly, as shown in FIGS. 3 through 7. The materials for upper canopy 50 are generally well known in the art and readily available. The lower canopy 52 should also be made out of a material that is sufficiently flexible so it can be repeatedly moved between the open position 46 and the closed position 58 of umbrella 10. Lower canopy 52 will be fixedly attached to the lower side of the frame 48 and will move with the frame 48 as the umbrella 10 moves between the open 46 and closed 58 positions. As will be readily appreciated by persons skilled in the art, water is kept off of the lower surface of upper canopy 50 and the frame 48, water which could otherwise drip or drain onto the user's clothes and surrounding area when the umbrella 10 is moved to its closed position 58.

Figure 6:
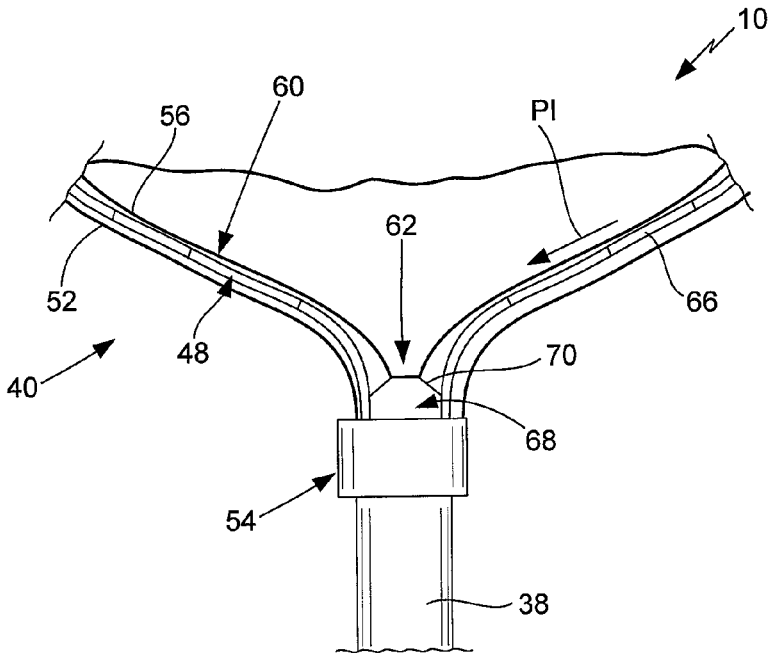
FIG. 6 is an enlarged partial side view of the umbrella of FIG. 3 shown in a partially closed position with the water drain path showing how water will flow inwardly toward the center of the canopy or handle when the umbrella is being closed.
Figure 7:
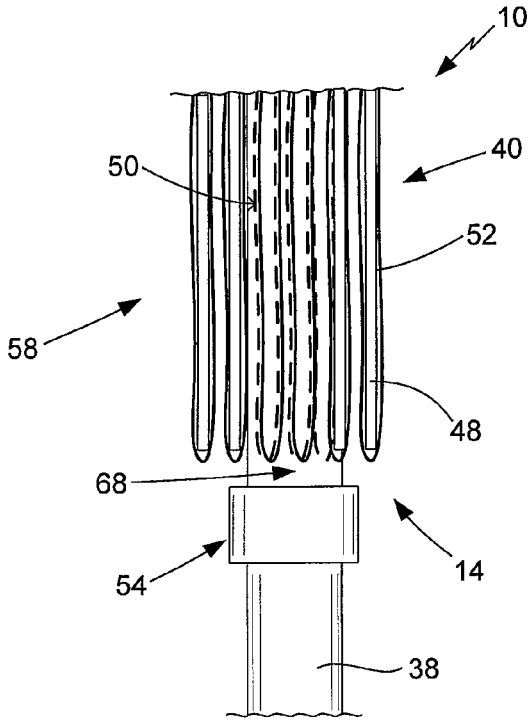
FIG. 7 is an enlarged partial side view of the present umbrella of FIG. 3 shown in its closed position with the upper canopy in the interior cavity of the handle and the frame and lower canopy shown collapsed around the handle.

To accomplish the objectives of the present invention, the upper end 42 of the handle 38 is at least generally open and is provided with an interior cavity 68 that is sized and configured to receive the upper canopy 50 therein when the umbrella 10 is move to its closed position 58, as best shown in FIGS. 6 and 7. The center area 62 of the upper canopy 50 will connect to the frame 48, and therefore to canopy operating mechanism 54, using one or more, typically a plurality, of wire-like connecting members 70 that will pull the center area 62 of upper canopy 50, and therefore the entire upper canopy 50, down into the interior cavity 68 at the upper end 42 of the handle 38 as the frame 48 collapses when the umbrella 10 is moved to the closed position 58. When the umbrella 10 is moved back to the open position 46, the connecting members 70 will pull the center area 62 of the upper canopy 50, and therefore the entire upper canopy 50 out of the interior cavity 68 so the frame 48 will be able to extend and peripherally support the upper canopy 50 so it will provide the desired protective cover, as shown in FIG. 3. As set forth above, the interior cavity 68 is sized and configured to accept at least substantially the entire upper canopy 50. The size necessary to achieve this objective can be obtained by providing an interior cavity 68 that extends down the handle 38 towards the lower end 44 thereof or by widening the area of handle 38 generally at or towards the upper end 42 of handle 38. In either configuration, interior cavity 68 should be sealed at the lower end thereof to prevent water from draining out the lower end 44 of the handle 38, which could get the user and/or his or her clothes wet. In this manner the water along the upper surface 60 of upper canopy 50 will drain along the inward water drain path PI into the interior cavity 68 of handle 38 instead of onto the surrounding area or the user's clothes. The user can then turn the umbrella 10 upside down or open it to drain the water from interior cavity 68 at a time and place that is convenient to him or her and where getting wet is not a problem (i.e., outside, in a garage sink, shower stall and etc.). The umbrella 10 can be left in an upside down position or in the open position 12 at an appropriate water-suitable area to dry.

The handle 38 of umbrella 10 can be made out of materials that are commonly utilized for umbrella handles, including plastic and other light weight and corrosion resistant. If desired, the handle 38 can be of the type that is made to be telescopically operated to allow the user to extend the handle 38 when the umbrella 10 is in use and to collapse the handle 38 when umbrella 10 is stored or otherwise not in use. The various possible configurations of telescoping handles for umbrellas are well known in the art. The canopy operating mechanism 54, which connects to the frame 48 and is supported by the handle 38, can also be of the type that is commonly utilized for collapsible umbrellas. In one embodiment, the canopy operating mechanism 54 is slidably disposed on the handle 38 such that upward movement of the canopy operating mechanism 54 will place the umbrella 10 in its open position 46 and downward movement of the canopy operating mechanism 54 will move the umbrella 10 to its closed position 58. The locking device 56 of canopy operating mechanism 54 may be of the conventional pop-up button or lever type that is well known in the art or it may be any other locking mechanism, such as a pin, retainer, hinge lock or the like. The locking device 56 is configured to hold the frame 38, upper canopy 50 and lower canopy 52 of umbrella 10 in place when the umbrella 10 is in the open position 46 and to be easily unlocked when the user desires to collapse these components and move the umbrella 10 to its closed position 58. If desired, a spring-operated or other mechanism can be utilized with umbrella 10 to mechanically extend and retract the handle, as shown relative to FIGS. 4 and 5, and/or to mechanically expand or collapse the canopy section 40. Such mechanisms are well known in the art, as exemplified by the U.S. Pat. No. 6,273,111 to Weiss (the disclosure of which is incorporated herein as though fully set forth in the present disclosure).

In use, umbrella 10 will typically be stored and carried in its closed position 58 until it is needed to protect the user from rain, snow, sleet, heavy fog and other sources of weather-related moisture. At that time, the user will hold the handle 38 and operate the canopy operating mechanism 54 to move the umbrella 10 to its open position 46 with the canopy section 40 expanded, as shown in FIG. 3, so as to provide protection for the user. The upper canopy 50 is peripherally supported by the expanded frame 48 when the umbrella 10 is in the open position 46. As with conventional umbrellas, water hitting the upper surface 60 of the upper canopy 50 will drain off of umbrella 10 along the upper surface 60 and past the downwardly disposed peripheral edge 64 thereof to fall away from the user who will be positioned more or less under the center area 62 of the upper canopy 50. When the user no longer needs the umbrella 10, such as when entering a vehicle, home, store or other area where the protection provided by umbrella 10 is not needed, he or she will operate the canopy operating mechanism 54 to move the umbrella 10 to its closed position 58. The canopy operating mechanism 54 will pull the upper canopy 50 downward into an interior cavity 68 at the upper end 42 of the handle 38 and move the peripheral edge 64 of the upper canopy 50 upward, as shown in FIGS. 4 and 5, to create a downward funnel-like shape that will direct any water on the upper surface 60 of the upper canopy 50 downward toward the center area 62 along inward water drain path PI instead of outward along conventional water drain path PC toward the peripheral edge 36 of the conventional umbrella 16. As the umbrella 10 closes, the upper canopy 50 is pulled into the interior cavity 68 and the frame 48 and lower canopy 52 are collapsed around the handle 38 at or near the upper end 42 thereof, with lower canopy 52 generally wrapped around the frame 48 and, as a result of the relative positioning thereof, the upper canopy 50. The water that accumulates in the interior cavity 68 with the upper canopy 50 can be poured out, at the user's convenience, by turning the closed umbrella 10 upside down or in an open position 46 to dry. As such, the water that accumulates on the upper surface 60 of the upper canopy 50 will not drain onto the area around the user.

While there are shown and described herein one or more specific embodiments of the invention, it will be readily apparent to those skilled in the art that the invention is not so limited, but is susceptible to various modifications and rearrangements in design and materials without departing from the spirit and scope of the invention. In particular, it should be noted that the present invention is subject to various modifications with regard to any dimensional relationships set forth herein, with regard to its assembly, size, shape and use and with regard to the materials used in its construction. For instance, there are a number of components described herein that can be replaced with equivalent functioning components to accomplish the objectives of the present invention.

What is claimed is:

1. An umbrella, comprising:

an elongated handle having an upper end and a lower end;

a canopy section disposed generally at said upper end of said handle, said canopy section having an upper canopy, a lower canopy and a frame attached to and disposed between each of said upper canopy and said lower canopy, said frame structured and arranged to peripherally support said upper canopy so an upper surface and an outwardly extending peripheral edge of said upper canopy will provide protective cover when said umbrella is in an open position and to collapse said upper canopy when said umbrella is moved to a closed position, said lower canopy attached to said frame and configured to extend below said upper canopy when said umbrella is in said open position and to collapse around said frame when said umbrella is in said closed position;

an interior cavity at said upper end of said handle, said interior cavity sized and configured to receive said upper canopy therein when said umbrella is moved to said closed position; and a canopy operating means associated with said handle and connected to said frame for moving said umbrella between its open position and its closed position, said canopy operating means configured to pull said upper canopy into said interior cavity when moving said umbrella to said closed position and to pull said upper canopy out of said interior cavity when moving said umbrella to said open position, wherein any water on said upper surface of said upper canopy when said umbrella is moved to said closed position is directed inwardly down an inward water drain path toward a center area of said upper canopy so as to prevent the water from draining outwardly past said peripheral edge of said upper canopy when said umbrella is moved to and disposed in said closed position.

2. The umbrella of claim 1, wherein said interior cavity is sized and configured to receive substantially all of said upper canopy therein.

3. The umbrella of claim 1, wherein said canopy operating means comprises one or more connecting members interconnecting said center section of said upper canopy and said frame, said connecting members structured and arranged to pull said center section of said upper canopy into said interior cavity when said umbrella is placed in said closed position.

4. The umbrella of claim 1, wherein said canopy operating means comprises a locking device that is configured to hold said umbrella in said open position.

5. The umbrella of claim 1, wherein said handle is telescopically configured.

6. An umbrella, comprising:

an elongated handle having an upper end and a lower end;

a canopy section disposed generally at said upper end of said handle, said canopy section having an upper canopy, a lower canopy and a frame attached to and disposed between each of said upper canopy and said lower canopy, said frame structured and arranged to peripherally support said upper canopy so an upper surface and an outwardly extending peripheral edge of said upper canopy will provide protective cover when said umbrella is in an open position and to collapse said upper canopy when said umbrella is moved to a closed position, said lower canopy attached to said frame and configured to extend below said upper canopy when said umbrella is in said open position and to collapse around said frame when said umbrella is in said closed position;

an interior cavity at said upper end of said handle, said interior cavity sized and configured to receive substantially all of said upper canopy therein when said umbrella is moved to said closed position;

a canopy operating means associated with said handle and connected to said frame for moving said umbrella between its open position and its closed position, said canopy operating means having a locking device that is configured to hold said umbrella in said open position, said canopy operating means configured to pull said upper canopy into said interior cavity when moving said umbrella to said closed position and to pull said upper canopy out of said interior cavity when moving said umbrella to said open position, wherein any water on said upper surface of said upper canopy when said umbrella is moved to said closed position is directed inwardly down an inward water drain path toward a center area of said upper canopy so as to prevent the water from draining outwardly past said peripheral edge of said upper canopy when said umbrella is moved to and disposed in said closed position.

7. The umbrella of claim 6, wherein said canopy operating means comprises one or more connecting members interconnecting said center section of said upper canopy and said frame, said connecting members structured and arranged to pull said center section of said upper canopy into said interior cavity when said umbrella is placed in said closed position.

8. The umbrella of claim 6, wherein said handle is telescopically configured.

9. An umbrella, comprising:

an elongated handle having an upper end and a lower end;

a canopy section disposed generally at said upper end of said handle, said canopy section having an upper canopy, a lower canopy and a frame attached to and disposed between each of said upper canopy and said lower canopy, said frame structured and arranged to peripherally support said upper canopy such that an upper surface thereof extends toward a downwardly disposed, outwardly extending peripheral edge of said upper canopy to provide protective cover when said umbrella is in an open position and to collapse said upper canopy when said umbrella is moved to a closed position, said lower canopy attached to said frame and configured to extend below said upper canopy when said umbrella is in said open position and to collapse around said frame when said umbrella is in said closed position;

an interior cavity at said upper end of said handle, said interior cavity sized and configured to receive said upper canopy therein when said umbrella is moved to said closed position; and a canopy operating means associated with said handle and connected to said frame for moving said umbrella between its open position and its closed position, said canopy operating means having a locking device configured to hold said umbrella in said open position, said canopy operating means configured to raise said peripheral edge of said upper canopy upward and to pull a center area of said upper canopy downward into said interior cavity when moving said umbrella to said closed position and to pull said upper canopy out of said interior cavity when moving said umbrella to said open position, wherein any water on said upper surface of said upper canopy when said umbrella is moved to said closed position is directed inwardly down an inward water drain path toward said center area of said upper canopy so as to prevent the water from draining outwardly past said peripheral edge of said upper canopy when said umbrella is moved to and disposed in said closed position.

10. The umbrella of claim 9, wherein said interior cavity is sized and configured to receive substantially all of said upper canopy therein.

11. The umbrella of claim 9, wherein said canopy operating means comprises one or more connecting members interconnecting said center section of said upper canopy and said frame, said connecting members structured and arranged to pull said center section of said upper canopy into said interior cavity when said umbrella is placed in said closed position.

12. The umbrella of claim 9, wherein said handle is telescopically configured.

* * * * *